US007072480B2

(12) United States Patent
Rass

(10) Patent No.: US 7,072,480 B2
(45) Date of Patent: Jul. 4, 2006

(54) HEARING AID SYSTEM WITH A HEARING AID AND AN EXTERNAL PROCESSOR UNIT

(75) Inventor: Uwe Rass, Nuremberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 13 days.

(21) Appl. No.: 10/458,394

(22) Filed: Jun. 10, 2003

(65) Prior Publication Data

US 2003/0235319 A1 Dec. 25, 2003

(30) Foreign Application Priority Data

Jun. 24, 2002 (DE) ..... 102 28 157

(51) Int. Cl.
*H04R 25/00* (2006.01)

(52) U.S. Cl. ..... 381/314; 381/315; 381/317

(58) Field of Classification Search ..... 381/314–315, 381/323, 317–318, 330, 320–321
See application file for complete search history.

(56) References Cited

U.S. PATENT DOCUMENTS

| | | | | |
|---|---|---|---|---|
| 4,920,570 | A * | 4/1990 | West et al. | 381/315 |
| 5,140,640 | A * | 8/1992 | Graupe et al. | 381/71.12 |
| 5,452,361 | A * | 9/1995 | Jones | 381/71.6 |
| 5,479,522 | A * | 12/1995 | Lindemann et al. | 381/23.1 |
| 5,524,056 | A * | 6/1996 | Killion et al. | 381/314 |
| 5,721,783 | A * | 2/1998 | Anderson | 381/328 |
| 5,721,789 | A * | 2/1998 | Loffler | 382/112 |
| 5,824,022 | A * | 10/1998 | Zilberman et al. | 607/57 |
| 6,021,207 | A * | 2/2000 | Puthuff et al. | 381/330 |
| 6,101,258 | A * | 8/2000 | Killion et al. | 381/321 |
| 6,112,103 | A * | 8/2000 | Puthuff | 455/557 |
| 6,275,596 | B1 * | 8/2001 | Fretz et al. | 381/321 |
| 6,445,799 | B1 * | 9/2002 | Taenzer et al. | 381/71.6 |

FOREIGN PATENT DOCUMENTS

| | | |
|---|---|---|
| DE | 100 48 341 | 4/2002 |
| DE | 100 48 354 | 5/2002 |
| WO | WO 01/52597 | 7/2001 |

OTHER PUBLICATIONS

U.S. Patent Application Publication No. US 2002/0044669 of Meyer et al., published Apr. 18, 2002.

* cited by examiner

*Primary Examiner*—Suhan Ni
*Assistant Examiner*—Phylesha Dabney
(74) *Attorney, Agent, or Firm*—Schiff Hardin LLP

(57) ABSTRACT

A hearing aid system has a hearing aid and an external processor unit, where the external processor unit is permanently allocated to a specific hearing environment. The external processor unit is fashioned for remaining in the respective hearing environment long-term, and the signal processing of an acoustic input signal in the external processor unit is also specifically adapted to the respective hearing environment. There is preferably a wireless signal transmission between the hearing aid and the external processor unit.

14 Claims, 2 Drawing Sheets

HEARING AID SYSTEM WITH A HEARING AID AND AN EXTERNAL PROCESSOR UNIT

BACKGROUND OF THE INVENTION

1. Field of the Invention

The invention is directed to a hearing aid system with a hearing aid, comprising at least one input transducer, a first signal processing unit, an output transducer and a reception unit, and with an external processor unit that comprises at least one second input transducer, a second signal processing unit and a transmission unit.

The invention is also directed to a method for the operation of a hearing aid having an input transducer, a first signal processing unit, an output transducer and a reception device.

2. Description of the Related Art

International Patent Publication WO 01/52597 discloses a hearing aid system with a transmission module. This transmission module comprises a microphone with which sound signals at a certain distance from the hearing aid can be picked up. After a signal editing, the signals are sent to the hearing aid via a transmitter and an antenna.

German Patent Document DE 100 48 354 A1 discloses a hearing aid system in which an external processor unit comprises a microphone that picks up sound signals from which acoustic field characteristics are generated. The acoustic field characteristics are wirelessly transmitted to one or two hearing aids.

German Patent Document DE 100 48 341 C1 discloses a hearing aid that, for automatic selection of a hearing program, recognizes whether it is located in the closer environment of an external transmitter. The transmitter generates a transmitter-specific signal, so that an allocation of different transmitters can ensue. Various hearing situations are allocated to the transmitters so that the hearing aid recognizes the momentary hearing situation upon reception of a transmitter-specific signal and adapts the signal processing in the hearing aid thereto.

U.S. Pat. No. 5,721,783 discloses a hearing aid system with a hearing aid and an external processor unit. A sound signal picked up by a hearing aid microphone is supplied via a wireless signal path to the external processor unit and processed therein. The processed signal is ultimately transmitted back to the hearing aid from the external processor unit via the wireless signal path and is output via an earphone.

What is disadvantageous about the known hearing aid systems is the lack of adaptability to specific hearing situations.

SUMMARY OF THE INVENTION

It is therefore an object of the present invention to improve the adaptability of a hearing aid system to difficult hearing environments.

In a hearing aid system with a hearing aid, which comprises at least one input transducer, a first signal processing unit, an output transducer and a reception unit, and with an external processor unit that comprises at least one second input transducer, a second signal processing unit and a transmission unit, this object is achieved in that the external processor unit is permanently allocated to a specific hearing environment, and a processing of an input signal picked up by the second input transducer that is adapted to the hearing environment ensues in the processor unit, where the external processor unit sends the processed signal via the transmission unit, and the hearing aid receives the transmitted signal with the reception unit and outputs it via the output transducer.

The object is also achieved by a method for the operation of a hearing aid having an input transducer, a first signal processing unit, an output transducer and a reception device that comprises the following:

a) offering an external processor unit with an input transducer, a second signal processing unit and a transmission device in a preferred hearing environment of the hearing aid user;

b) adapting the signal processing in the external processor unit to the hearing environment;

c) picking up and processing an input signal with the external processor unit; and d) sending the processed signal to the hearing aid, receiving the transmitted signal with the hearing aid and output via the output transducer.

DESCRIPTION OF THE DRAWINGS

Further details of the invention derive from the following description of an exemplary embodiment and the figures pertaining to the exemplary embodiment.

DETAILED DESCRIPTION OF THE PREFERRED EMBODIMENTS

Figure 1:
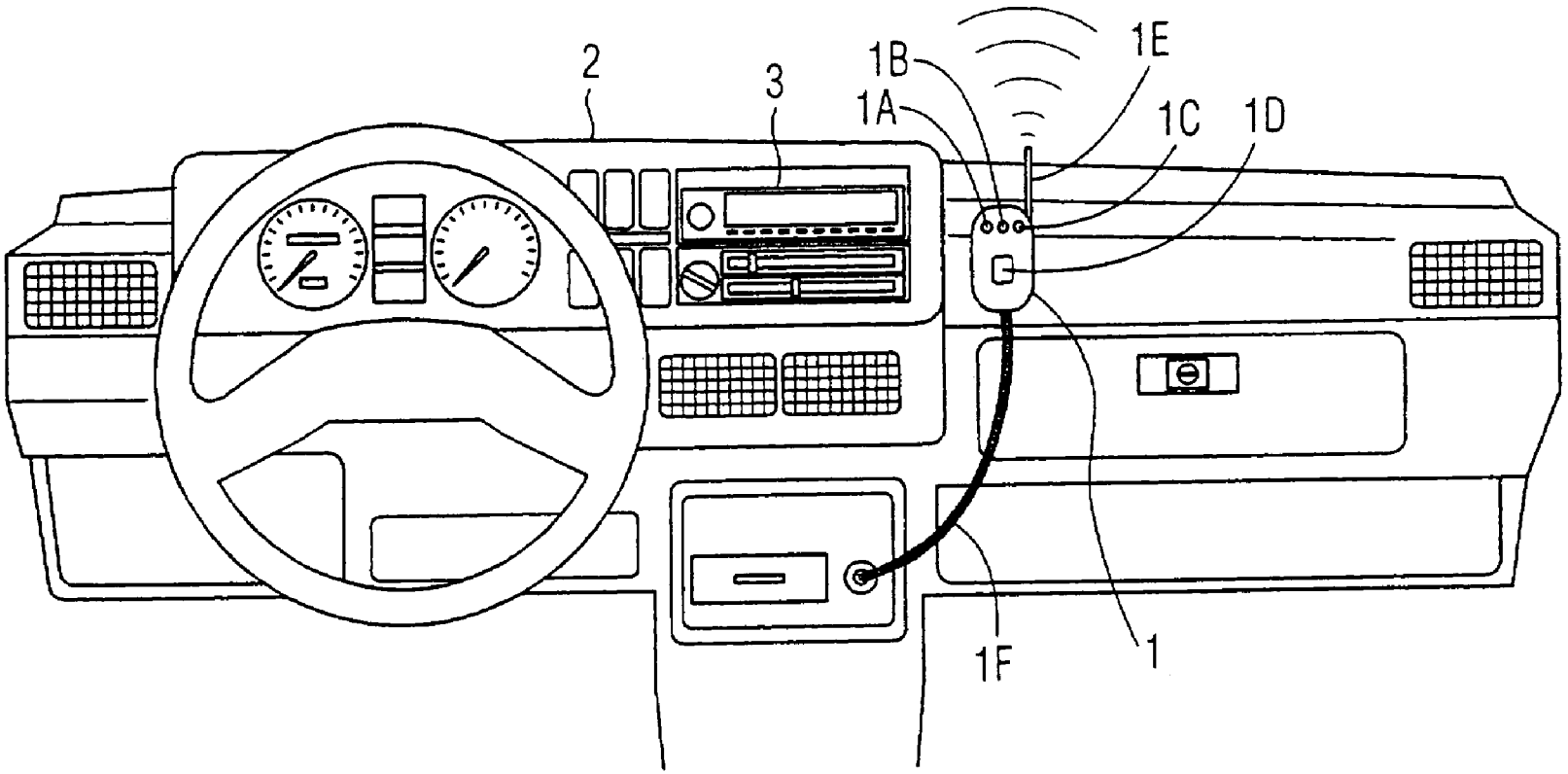
FIG. 1 is a pictorial diagram illustrating an arrangement of an external processor unit in an automobile.

Embodiments of the invention may be, for example, a hearing aid worn behind the ear, a hearing aid worn in the ear, an implantable hearing aid or a pocket hearing aid device. The hearing aid also may be part of a hearing aid system comprising a plurality of devices for servicing a hearing-impaired person, for example, part of a hearing aid system having two hearing aids worn at the head for binaural coverage, part of a hearing aid system with a hearing aid worn at the head and an external processor unit carried on the body, part of an entirely or partly implantable hearing aid system having a plurality of components, part of a hearing aid system with external auxiliary components such as remote control unit or external microphone unit, etc.

A hearing aid usually comprises an input transducer for picking up an input signal. For example, the input transducer may be fashioned as a microphone that picks up an acoustic signal and converts it into an electrical signal. However, units that comprise input transducers such as a coil or an antenna and that pick up an electromagnetic signal and convert it into an electrical signal may also be considered. A hearing aid also usually comprises a signal processing unit for the processing and frequency-dependent amplification of the electrical signal. What is preferably a digital signal processor (DSP) serves for the signal processing in the hearing aid, its functioning capable of being influenced with programs or parameters that can be transmitted into the hearing aid. The functioning of the signal processing unit can thus be adapted both to the individual hearing loss of a hearing aid user as well as to the current hearing situation in which the hearing aid is being operated at the moment. The electrical signal modified in this way is ultimately supplied to an output transducer. This is usually fashioned as an earphone that converts the electrical output signal into an acoustic signal. However, other embodiments are also possible, for example, an implantable output transducer that is directly connected to an auditory ossicle and causes this to oscillate.

The external processor unit of the hearing aid system may be permanently allocated to a specific hearing situation, i.e., arranged in a specific hearing environment such as being secured in an automobile. The external processor unit comprises at least one input transducer, which is preferably fashioned as a microphone, a signal processing unit-and a transmission unit. A telephone coil for the reception of an electromagnetic inputs signal can also be present as an input transducer.

The signal processing in the external processor unit may be specifically adapted to the hearing environment in which the external processor unit is located. This is particularly provided for difficult hearing environments. Such hearing environments can, for example, be the automobile or a work place with a high unwanted noise component. The proximity to window panes that frequently produce feedback-conditioned oscillations in the hearing aid represents a particular problem given hearing aid coverage in the car. This problem is avoided by using the external processor unit due to the spatial separation of signal-detecting microphone and earphone.

Conversation with a passenger is also problematical in the hearing environment in a car, since the signal source is not situated, as usual, in the direction of view of the hearing aid user but is laterally directed to the user. This problem can also be avoided by the external processor unit with a microphone that is arranged in front of the passenger.

The signal processing in the external processor unit is advantageously set such that the difficulties connected with the hearing environment are largely eliminated. To that end, filters or signal processing algorithms specifically adapted to this hearing situation can be activated. The signal processing in the external processor unit can ensue in parallel in a plurality of frequency channels.

Hearing aid users usually desire small and, thus, optimally inconspicuous hearing aids. As a result, there is only relatively little space available in the hearing aids for electronic components, so that the computing power of the digital signal processing unit within the hearing aid is also limited. These limitations usually do not apply given an external processor unit. The chip area and, thus, computing power required for an appropriate signal processing in the respective hearing situation can thus be made available.

The external processor unit is advantageously programmable for adaptation to different hearing environments, i.e., run programs for the control of the signal processing in the external processor unit can be transmitted onto the external processor unit or parameters relating to the signal processing can be set. As a result of the programming, external processor units with the same structure can be manufactured and optimized for different hearing environments.

Given a hearing aid system with a hearing aid and an external processor unit, the hearing aid must be prepared to receive a signal of the external processor unit. An acoustic signal can thus be picked up by the input transducer of the external processor unit, processed by the signal processing unit and transmitted onto the hearing aid with the transmission unit. The hearing aid system preferably comprises a wireless transmitter for transmitting a signal from the external processor unit onto the hearing aid. When the signal path between the external processor unit and the hearing aid is bidirectionally fashioned, then the external processor unit can also advantageously receive a signal output by the hearing aid. For example, settings at the external processor unit can thus be undertaken via the hearing aid.

One embodiment of the invention provides that the hearing aid be set to the reception of a signal of the external processor unit by actuating an operating element. For example, the signal transmitted from the external processor unit may then be mixed with the signal picked up by the microphone of the hearing aid. The weighting of the two signals can be advantageously set so that the signal of the hearing aid microphone is not further-processed in the extreme case, and only the signal picked up by the external processor unit proceeds to the earphone of the hearing aid.

Another embodiment of the invention results in the hearing aid automatically recognizing whether it is located in the closer proximity of an operating external processor unit and, as warranted, automatically adapting the signal processing to this hearing situation. Conversely, the hearing aid returns into the normal operating mode when a signal of an external processor unit is no longer received. For recognizing the proximity to a specific external processor unit, for example, the presence, the frequency and the level of a carrier signal that is output from a specific external processor unit for the transmission of the further-processed acoustic input signal can be checked. A distinction between different external processor units that the hearing aid can receive is then also possible due to different carrier frequencies. The further-processing of the received signal in the hearing aid can then also ensue differently depending on the respective external processor unit from which the hearing aid receives a signal. Furthermore, settings or functions of the hearing aid itself can be adapted dependent thereon, for example, microphones can be activated or deactivated.

In a preferred embodiment, the external processor unit also comprises a directional microphone system for generating a directional microphone characteristic for adaptation to specific hearing environments. This is particularly advantageous when the privileged direction of incidence of useful signals and the privileged direction of incident of noise signals can be clearly recognized, as is the case, for example, in the car. The directional characteristic of the external processor unit can preferably be manually or automatically set. In particular, a fine adaptation to the respective hearing situation can thus also be achieved.

One embodiment of the invention provides that the signal transmitted from the external processor unit onto the hearing aid is further-processed in the signal processing unit of the hearing aid. The adaptation to the individual hearing loss of the hearing aid user by the signal processing unit of the hearing aid can thus also ensue given the signal transmitted onto the hearing aid from the external processor unit.

Referring to the embodiments shown in the drawings, FIG. 1 shows an external processor unit 1 of a hearing aid system of the invention that is secured to the dashboard 2 of an automobile. The fastening ensues, for example, with a screwed connection, a plug-in connection, a glued connection, a magnetic mount, etc. The external processor unit 1 can also be arranged in a concealed manner in the automobile. As a result of being arranged in the automobile, the external processor unit 1 is permanently allocated to hearing situation "automobile". Non-directional microphones that are electrically interconnected to form a directional microphone system are concealed behind the sound admissions 1A, 1B and 1C of the external processor unit 1.

The external processor unit 1 may also comprise an on/off switch 1D, an antenna 1E as well as a signal processing unit in the form of a digital signal processor (not shown). The acoustic signals picked up by the microphones are further-processed in the signal processing unit, where the signal processing in the exemplary embodiment is specifically adapted to the hearing situation "automobile". For supplying the power of the external processor unit 1, this is connected via a cable 1F to the power supply of the automobile. In order to avoid noise signals that are caused by reflections at the window panes, the external processor unit 1 may preferably be arranged on the passenger side of the automobile in the region of a car radio 3.

The hearing situation "automobile" is only one of many examples in which the application of an external processor unit specifically adapted to the respective hearing situation is meaningful. The invention is therefore not limited to the hearing situation "automobile" shown in the exemplary embodiment.

Figure 2:
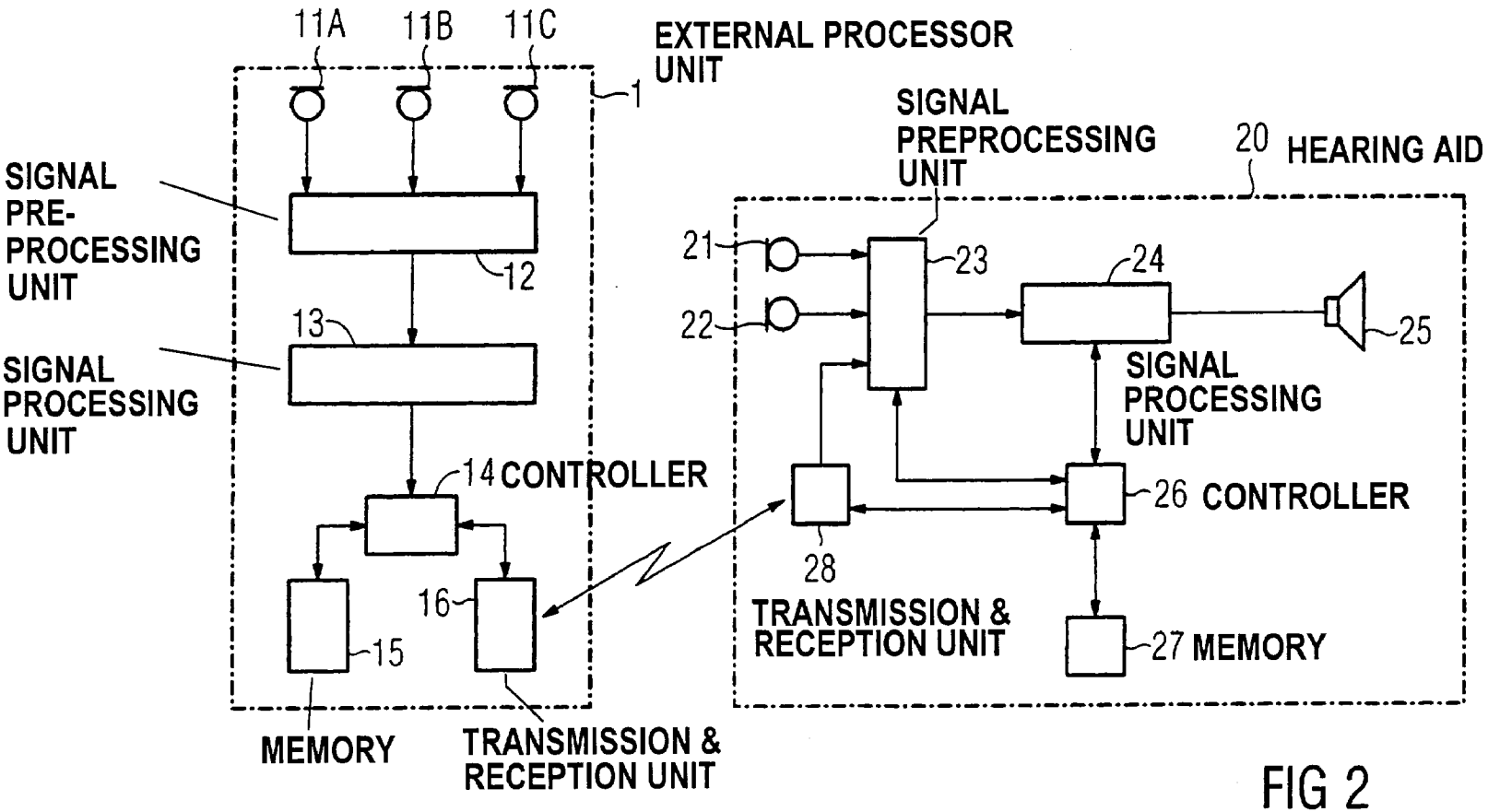
FIG. 2 is a simplified block circuit diagram of a hearing aid system according to a preferred embodiment.

In a simplified schematic illustration, FIG. 2 shows the block circuit diagram of a hearing aid system 1, 20 of the invention having a hearing aid 20 that comprises the two microphones 21 and 22 for picking up an acoustic signal and converting it into an electrical signal. The microphone signals are first supplied to a signal pre-processing unit 23. This, for example, can comprise A/D converters. Furthermore, a directional characteristic can be generated with the two microphones 21 and 22 using a delay element contained in the signal pre-processing unit 23 as well as an addition element, this directional characteristic being achieved, for example, with the delay element utilizing a variable delay time. The pre-processed microphone signal is finally supplied to the signal processing unit 24. The signal processing for compensating the individual hearing impairment of the hearing aid user occurs within. Finally, the processed signal—potentially following a D/A conversion—is supplied to an earphone 25 for conversion back into an acoustic signal.

For adapting the hearing aid 20 according to FIG. 2 to different hearing environments as well as for individual adaptation to a hearing aid user, the hearing aid 20 comprises a control unit 26 in combination with a memory unit 27. Thus, the parameters and settings relating to the signal processing or specific functions of the hearing aid 20 such as an algorithm for noise signal suppression or an algorithm for boosting the voice signal can be switched on/off depending on the respective hearing situation as well as the needs of the hearing aid user. The setting of the directional characteristic of the microphone system 21, 22 is also set by the control unit 26 in combination with the signal pre-processing unit 23.

A transmission and reception unit 28 is also provided in the hearing aid 20 for wireless programming of the hearing aid 20. Run programs pertaining to the signal processing as well as parameters and settings can be transmitted onto the hearing aid with the unit 28 and, for example, be deposited in the memory unit 27.

In order to improve the assistance given a hearing aid user, particularly in difficult hearing environments, a hearing aid system 1, 20 of the invention may be formed from the hearing aid 20 together with an external processor unit 1. The external processor unit 1 according to the exemplary embodiment may comprise three microphones 11A, 11B and 11C. These also acquire acoustic input signals and convert them into electrical input signals. For generating different, particularly adjustable directional characteristics, signals of the microphones 11A, 11B, 11C of the external processor unit 1 may also be first supplied to a signal pre-processing unit 12. The actual signal processing may then occur in the signal processing unit 13.

The external processor unit 1 may be permanently allocated to a specific hearing environment. As shown in FIG. 1, for example, the external processor unit 1 can be attached in an automobile. The signal processing in the signal processing unit 13 may then be specifically matched to this hearing environment. Thus, a specific directional characteristic can be set, and selected frequency ranges in which noise can be expected can be amplified less compared to frequency ranges containing useful signals, for example voice, are expected and that are specifically emphasized.

So that one and the same external processor unit 1 can also be operated as needed in different hearing environments, this is programmably fashioned, comparable to the hearing aid 20. The external processor unit 1 therefore may comprise a control unit 14, a memory unit 15 as well as a transmission and reception unit 16. The control unit 14 can set the current run program for controlling the signal processing in the signal processing unit 13. The control unit 14 may be connected to a memory unit 15 for this purpose. For programming the external processor unit 1, this may also be equipped with a transmission and reception unit 16 with which a wireless signal transmission to a programming device (not shown) is enabled.

When a hearing aid user wearing a hearing aid 20 proceeds into the closer proximity of the operating, external processor unit 1, then the hearing aid 20 can recognize this and automatically adapt the internal signal processing to this hearing situation. A signal that may be picked up by, e.g., the microphones 11A, 11B and 11C and processed in the signal processing unit 13 may thus be wirelessly transmitted onto the hearing aid 20 via the transmission and reception unit 16 and the transmission and reception unit 28 of the hearing aid 20.

The transmitted signal may be mixed with the microphone signals of the microphones 21 and 22 in the signal pre-processing unit 23. The weighting of the individual signals is preferably adjustable and may be set by the control unit 26. For example, the signal generated by the two microphones 21 and 22 can be given the same weight as the signal transmitted from the external processor unit 1. The resulting signal may then be ultimately supplied to the signal processing unit 24. In this operating mode, (reception of a signal of the external processor unit 1), the latter may be operated in a hearing program specifically designed for this situation. Finally, the processed signal may be converted back into an acoustic signal by the earphone 25 and supplied to the hearing of the hearing aid user.

When the hearing aid user leaves the range of influence of the external processor unit 1, then the hearing aid 20 may automatically recognize this, for example, in that a corresponding signal cannot be received with a required signal strength, and switche back into a "normal" hearing program.

The invention offers the advantage that an optimum adaptation of the hearing aid system 1, 20 to a specific hearing situation can ensue by employing an external processor unit 1.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming language such as C, C++, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

1 external processor unit
1A, 1B, 1C microphone admissions
1D on/off switch
1E antenna
1F cable
2 dashboard
3 car radio
11A, 11B, 11C microphones
12 signal pre-processing unit
13 signal processing unit
14 control unit
15 memory unit
16 transmission and reception unit
20 hearing aid
21, 22 microphones
23 signal pre-processing unit
24 signal processing unit
25 earphone
26 control unit
27 memory unit
28 transmission and reception unit

What is claimed is:

1. A hearing aid system, comprising:

a hearing aid, comprising:

at least one input transducer;

a first signal processing unit configured to receive a signal from the at least one input transducer;

an output transducer configured to receive a processed signal from the first signal processing unit and convert the signal into audible sound waves; and a reception unit;

the hearing aid system further comprising:

an external processor unit that is permanently allocated to a specific hearing environment, and is configured to process a received signal, thereby producing an external unit processed signal, adapted to the specific hearing environment, the external processing unit comprising:

at least one second input transducer configured to receive the received signal for processing by the external processing unit;

a second signal processing unit connected to the at least one second input transducer; and a transmission unit configured to send the external unit processed signal to the reception unit of the hearing aid so that the reception unit can output the processed signal to the output transducer.

2. The hearing aid system according to claim 1, wherein the external processor unit is fashioned for fixed allocation to different hearing environments, and the second signal processing unit is configured to be adapted to different hearing environments.

3. The hearing aid system according to claim 2, wherein the external processor unit is configured to be set by at least one of parameters and function for adapting the second signal processing unit to the hearing environment.

4. The hearing aid system according to claim 1, wherein the external processor unit comprises:

a directional microphone system configured for generating a directional microphone characteristic.

5. The hearing aid system according to claim 4, wherein the directional microphone characteristic is adjustable.

6. The hearing aid system according to claim 1, wherein the hearing aid is configured to be adaptable to the reception of a signal of the external processor unit.

7. The hearing aid system according to claim 6, further comprising a total of more than one external processor units that are permanently allocated to different hearing environments, the hearing aid being adaptable to the reception of signals of the different external processor units.

8. The hearing aid system according to claim 6, wherein the hearing aid is configured to automatically recognize whether the reception unit receives a signal of an external processor unit, and the hearing aid is automatically adaptable to the reception of this signal.

9. The hearing aid system according to claim 6, wherein the first signal processing unit is configured to be adaptable to the reception of a signal of the external processor unit.

10. The hearing aid system according to claim 1 configured to further-process the received signal in the hearing aid before the signal is output.

11. The hearing aid system according to claim 10 configured such that the received signal is mixable with a signal picked up by the first input transducer.

12. The hearing aid system according to claim 11 configured such that the signals are mixable with adjustable weighting.

13. A method for operating a hearing aid, comprising:

providing an input transducer, a first signal processing unit, an output transducer and a reception device;

permanently providing an external processor unit with an input transducer, a second signal processing unit and a transmission device in a specific hearing environment of a hearing aid user;

adapting a signal processor in the external processor unit to the hearing environment;

receiving and processing an input signal with the external processor unit, thereby producing a processed signal;

sending the processed signal to the hearing aid as a transmitted signal;

receiving the transmitted signal with the hearing aid; and outputting an output signal based on the transmitted signal via the output transducer.

14. The method according to claim 13, further comprising further processing the received signal before the signal is output.

* * * * *